US006412195B1

(12) United States Patent
Mack et al.

(10) Patent No.: US 6,412,195 B1
(45) Date of Patent: Jul. 2, 2002

(54) PROTECTIVE FOOTWEAR FOR USE WITH RUNNING SHOES, SNEAKERS

(76) Inventors: Aundra Mack; Kimm Mack, both of 2317 Old Camden Rd., Hartsville, SC (US) 29550-9401

( * ) Notice: Subject to any disclaimer, the term of this patent is extended or adjusted under 35 U.S.C. 154(b) by 0 days.

(21) Appl. No.: 09/880,639

(22) Filed: Jun. 14, 2001

(51) Int. Cl.[7] ..... A43K 13/14; A43B 7/14; A43B 5/00

(52) U.S. Cl. ..... 36/77 R; 36/77 M; 36/96; 36/114

(58) Field of Search ..... 36/77 R, 77 M, 36/96, 114

(56) References Cited

U.S. PATENT DOCUMENTS 1,118,755 A * 11/1914 Fiscus ..... 36/77 R
1,564,607 A * 12/1925 Meier ..... 36/77 R
1,582,232 A 4/1926 Vinzant
1,715,299 A * 5/1929 Macdonald ..... 36/77 R
2,292,297 A * 8/1942 Sherlock ..... 36/77 R
2,444,931 A * 7/1948 Heaton et al. ..... 36/77 M
2,795,868 A * 6/1957 Shultz ..... 36/77 R
3,178,836 A * 4/1965 Turner ..... 36/77 R
3,250,025 A 5/1966 Crescent
3,593,438 A * 7/1971 Mitchell ..... 36/77 R
3,805,419 A * 4/1974 White ..... 36/77 R
3,950,865 A 4/1976 Gray
4,991,318 A 2/1991 Cornell
D316,772 S 5/1991 Rose
5,074,060 A * 12/1991 Brncick et al. ..... 36/77 R
D341,699 S 11/1993 Williams, Jr. et al.
6,067,732 A 5/2000 Dodge

* cited by examiner

*Primary Examiner*—Anthony D. Stashick
(74) *Attorney, Agent, or Firm*—Donald R. Schoonover

(57) ABSTRACT

A one-piece toe plate is removably placeable inside the toe box of a shoe such as a running shoe, a sneaker or the like to protect the wearer's toes. The footwear can thus be used in a work situation requiring foot protection, but will be comfortable and amenable to changing shoes.

17 Claims, 3 Drawing Sheets

PROTECTIVE FOOTWEAR FOR USE WITH RUNNING SHOES, SNEAKERS

BACKGROUND OF THE INVENTION

1. Technical Field of the Invention

The present invention relates to the general art of footwear, and to the particular field of foot protection.

2. Description of the Related Art

Millions of professional tradesmen, including brick layers, carpenters and electricians, are required to wear steel toe shoes on a job site. These shoes prevent one's feet from being seriously injured in the event a heavy object, such as a power tool or beam or the like falls onto the worker's foot.

Therefore, there is a need for a workshoe that can adequately protect a worker's foot in the event a heavy object falls on the worker's foot.

Accordingly, the art contains many examples of workshoes that have some form of protection for the worker's foot. These examples usually include some form of protection on the shoe, such as a plate or the like. However, comfort is one consideration for any shoe, including a safety shoe. If the shoe is uncomfortable, the worker will not wear it and it can do him or her no good. Therefore, some disclosures in the art are directed to comfortable shoes that will also protect the worker's foot. Since plates can be heavy and thus will add weight to a shoe, and a heavy shoe is not as comfortable as a light one, one solution to this problem is to protect only the portion of the worker's foot that is most in danger while leaving the remaining portion of the foot unprotected. In this manner, the shoe can be as light as possible since only a portion of the shoe will be reinforced.

However, even these solutions have drawbacks because steel plates do not allow full circulation of air through the shoe and the shoe may become hot after a lengthy period of wear. This makes the shoe uncomfortable.

Therefore, there is a need for a workshoe that can adequately protect a worker's foot in the event a heavy object falls on the worker's foot, yet will be as comfortable as possible.

Still another drawback to presently available reinforced work shoes is that they are not versatile. That is, once purchased, the worker is restricted to the particular shoe. However, many workers want a variety of shoes that permit him or her to wear different shoes depending on his or her needs and/or desires.

Accordingly there is a need for a workshoe that can adequately protect a worker's foot in the event a heavy object falls on the worker's foot yet is versatile.

Still further, many workers feel most comfortable in shoes that are known as running shoes. A running shoe is often a flexible soft shoe having a canvas-type vamp, a canvas-type upper and the like. However, at the present time, it is not possible to wear such shoes in a workplace environment that requires foot protection.

Therefore, there is a need for a workshoe that can adequately protect a worker's foot in the event a heavy object falls on the worker's foot while permitting the worker to wear footwear of his or her choice.

There is still a further need for a workshoe that can adequately protect a worker's foot in the event a heavy object falls on the worker's foot while permitting a worker to wear so-called running shoes.

OBJECTS OF THE INVENTION

It is a main object of the present invention to provide a workshoe that can adequately protect a worker's foot in the event a heavy object falls on the worker's foot.

It is another object of the invention to provide a workshoe that can adequately protect a worker's foot in the event a heavy object falls on the worker's foot, yet will be as comfortable as possible.

It is another object of the present invention to provide a workshoe that can adequately protect a worker's foot in the event a heavy object falls on the worker's foot yet is versatile.

It is another object of the present invention to provide a workshoe that can adequately protect a worker's foot in the event a heavy object falls on the worker's foot while permitting the worker to wear footwear of his or her choice.

SUMMARY OF THE INVENTION

These, and other, objects are achieved by a protective toe plate that can be easily inserted into a running-type shoe yet will not irritate the worker's foot and can be removed for insertion into another shoe.

By being amenable for use in running-type shoes, the protective toe plate of the present invention allows the worker to wear comfortable shoes yet have his feet efficiently protected. This will increase the comfort for the worker and allow him or her to have more energy and increase work efficiency. Worker stamina is also increased because the feet are comfortable. Furthermore, morale is increased because the worker can select the shoes that are most desired at the time.

For the purposes of this disclosure, a running shoe is a shoe that includes a lightweight construction, often of a canvas-type material and can be of the type that runners, joggers or walkers use. It can also be known as a tennis shoe.

More specifically, the toe plate of the present invention includes a one-piece steel U-shaped element that has a central section that fits over a wearer's toes when the element is in place inside a toe box of a shoe and has two wings, with one wing being located on the central section to be interposed between a wearer's big toe and one side of the shoe and the other wing being located to be interposed between a wearer's little toe and the other side of the shoe when the toe plate is in position over a wearer's toes inside the toe box of a shoe. The wings are tapered from the central section so the toe plate can be easily inserted into and removed from a shoe and so the wings will not rub the wearer's foot when in use. The toe plate also can include covers and cushions for further ensuring comfort.

The toe plate can be easily inserted into and/or removed from a soft shoe such as a running shoe or walking shoe.

More specifically, the footwear construction of the present invention includes athletic shoes, either designed for running or for walking. The shoe could be comprised of canvas, nylon mesh, or leather or from a combination of these materials. The canvas can be of any suitable type, including warp, weft, map canvas, diamond twill canvas, scrip tip canvas, or the like. Each shoe can be produced with a sole arch support as well as an ankle support pad. The shoe can be equipped with a thick rubber sole, designed to absorb a great deal of friction. The rubber compound adds increased slip resistance. The front of the shoe will include a U-shaped toe protector which can include suitable covers and/or cushions to prevent contact between the user's foot and a steel plate of the toe protector. The shoe can contain a molded EVA cushioned midsole with a midsole wedge MS (see FIG. 6) that will provide excellent shock absorption. A geranium in-sole can reduce bacteria and the shoe can contain polyurethane foam that is soft, flexible and will provide thermal insulation to protect workers that are exposed to cold weather. The footwear can also contain latex products that focus on lightness.

The footwear can be produced in a wide variety of sizes including both men's and women's sizes and both men's and women's styles thereby allowing the footwear to be worn by a wide variety of consumers. The footwear is lightweight and versatile as well as comfortable and is amenable to displaying suitable logos and designs thereby further increasing the versatility thereof.

BRIEF DESCRIPTION OF THE DRAWING FIGURES

DETAILED DESCRIPTION OF THE INVENTION

Other objects, features and advantages of the invention will become apparent from a consideration of the following detailed description and the accompanying drawings.

Figure 1:
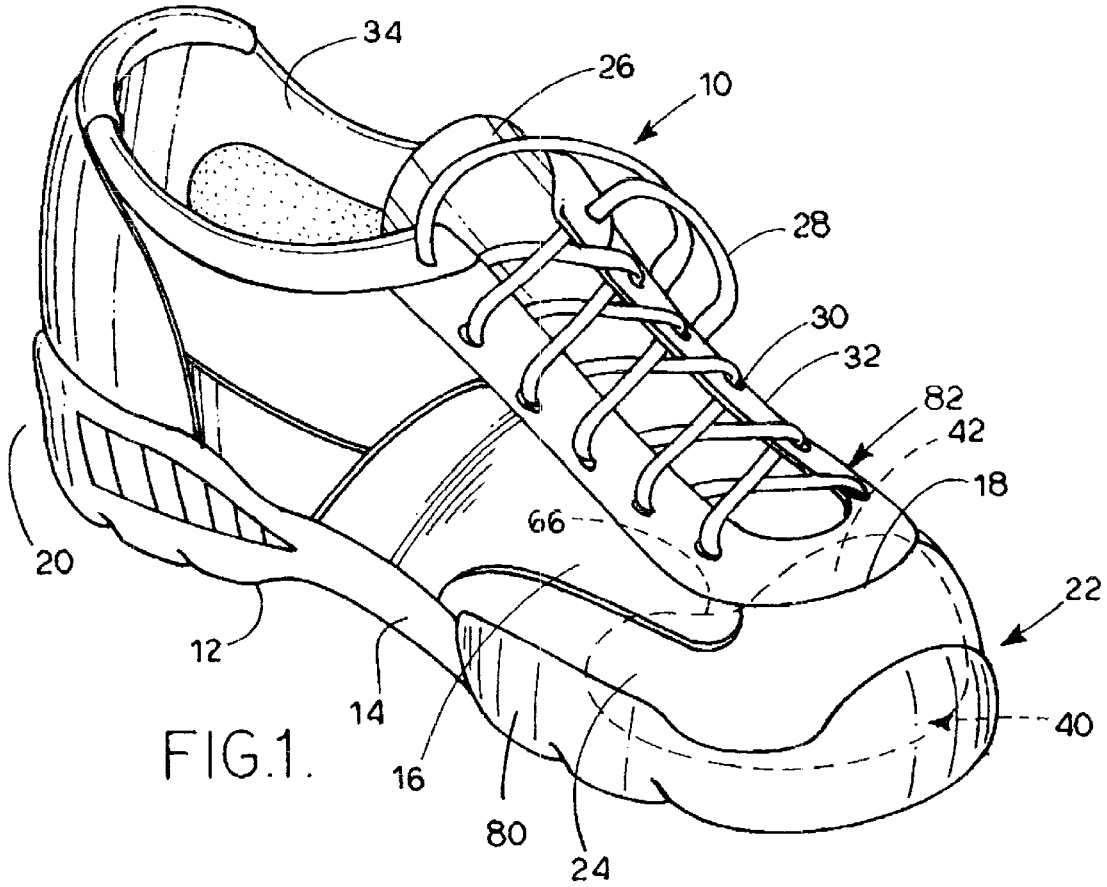
FIG. 1 is a front and top perspective view of a shoe of the type of interest to this invention having a toe plate therein in accordance with the teaching of this disclosure.

Shown in FIG. 1 is a running-type or athletic-type shoe 10 which includes an outsole 12 and a sole 14 which are of a rubber-type or plastics-type material, an upper 16 and a vamp 18 that are formed of a canvas-type material that is soft and flexible, a heel section 20, a toe box 22, trim 24 and a tongue 26. Laces 28 fit through eyelets 30 in an eyestay 32 and padding 34 ensures comfort.

As discussed above, shoe 10 is comfortable, lightweight, flexible and such shoes have been extremely popular in recent times. The present invention makes it possible for a worker to wear a shoe of the type shown at number 10 in FIG. 1 with all of the advantages associated therewith while still having his or her foot protected.

To this end, shoe 10 includes a protective toe plate 40 located inside toe box 22 of shoe 10. Toe plate 40 is removably positioned inside toe box 22 and thus can be removed from one shoe and placed in another shoe while still providing the desired protection.

Figure 3:
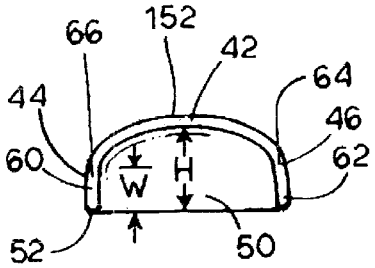
FIG. 3 is a reduced, end view of the toe plate shown in FIG. 2 as seen from view 3 in FIG. 2.
Figure 4:
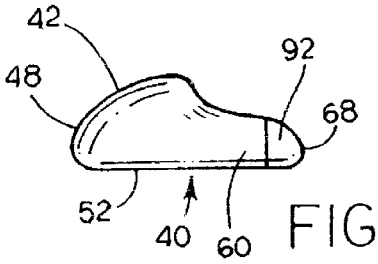
FIG. 4 is a side elevational view of the toe plate.
Figure 6:
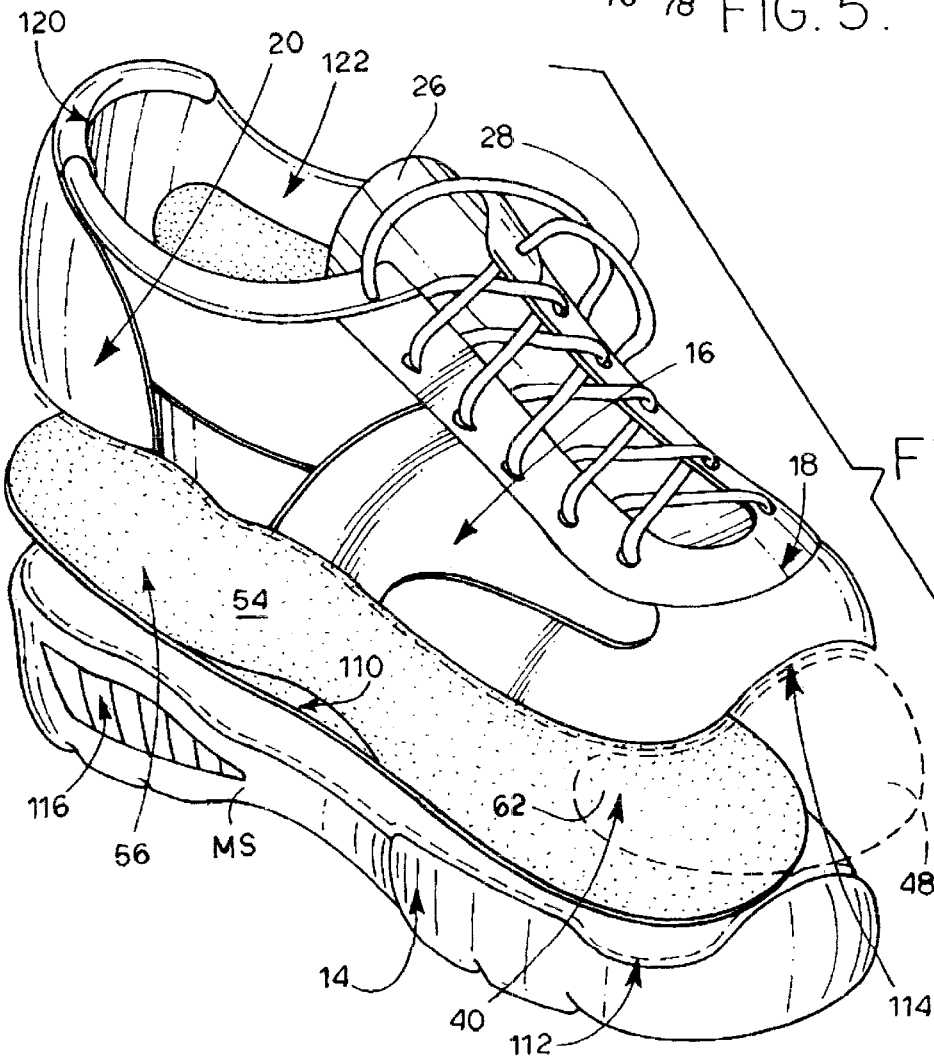
FIG. 6 is an exploded perspective view of footwear construction showing the toe plate and an insole.

Toe plate 40 is a one-piece construction for greater strength, and can be steel or like material that will provide the desired protection in the event that a heavy object falls on the wearer's foot. Toe plate 40 includes a central section 42 that is clam-shell like in configuration and has a U-shaped cross-section as best seen in FIG. 3 to have two sides 44 and 46, a tip section 48 and an open bottom section 50. Toe plate 40 also has a lower or bottom rim 52 that will rest on the top surface 54 of an insole 56 (see FIG. 6) with central section 42 extending over the wearer's toes in tent-like fashion with tip section 48 in abutting contact with the inside surface of the shoe in toe box 22 and upper or top surface 58 of central section 42 in abutting contact with the inside surface of vamp 18.

Figure 2:
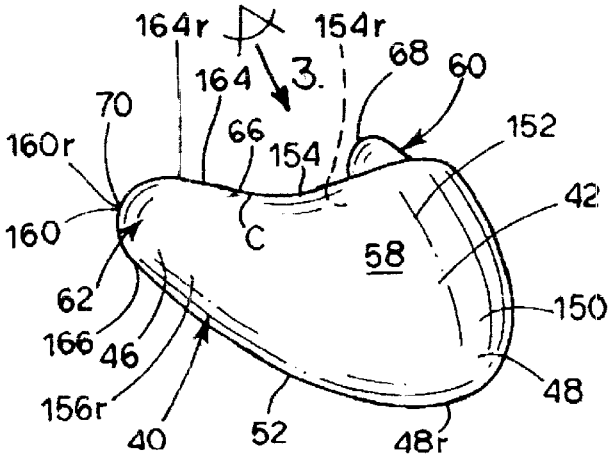
FIG. 2 is a perspective view of a toe plate embodying the teaching of the present invention.

As is shown in FIG. 2, toe plate 40 includes two wings 60 and 62 that extend outwardly from central section 42 in a rearward direction toward heel section 20 when toe plate 40 is in place inside the toe box 22 of shoe 10. Each section includes a tapered portion 64 and 66 respectively that gradually decreases in height as measured between bottom rim 52 and top surface 58 of central section 42 with rearmost tips 68 and 70 of wings 60 and 62 respectively having the shortest heights of the toe plate 40. The tapering of the wings 60 and 62 adds comfort to the toe plate 40 and prevents it from rubbing against the wearer's toe or foot and also permits the toe plate 40 to be used with a wide variety of shoe sizes and styles.

Figure 5:
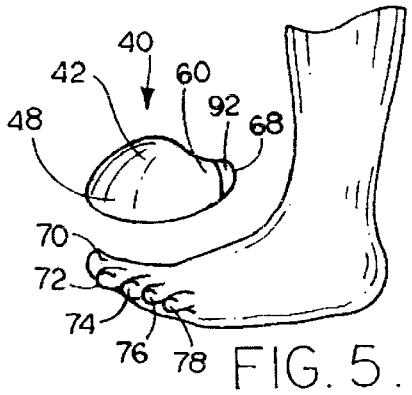
FIG. 5 shows a reduced, perspective view of a wearer's foot in relation to the toe plate.

As shown in FIG. 5, toe plate 40 fits over the wearer's foot with central section 42 extending over all of the wearer's toes, including the big toe 71, the second toe 72, the third toe 74, the fourth toe 76 and the little toe 78. Wing 62 is located adjacent to big toe 71 and is interposed between big toe 71 and the inside surface of side 80 while wing section 60 is located adjacent to little toe 78 and is interposed between little toe 78 and the inside surface of side 82 of the shoe. This protects the toes while preventing rubbing.

Figure 7:
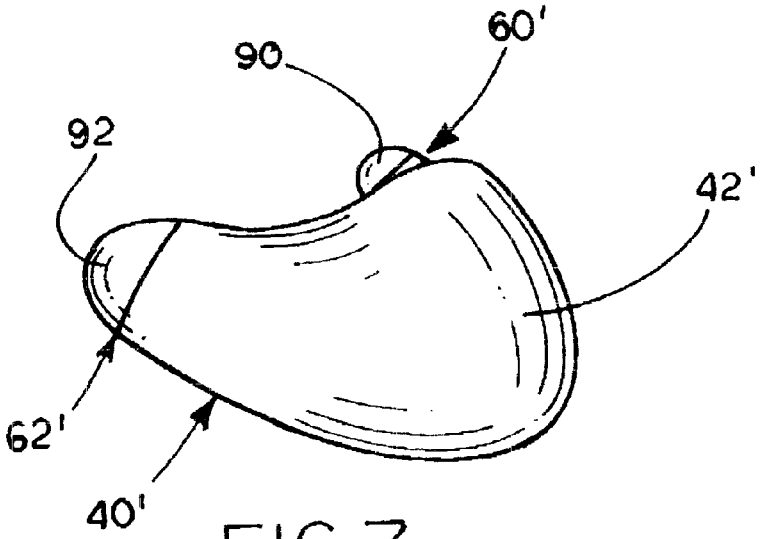
FIG. 7 is a perspective view of a toe plate having covers on the tips of the wings thereof.

To further ensure comfort, elastomeric wing tip covers 90 and 92 can be placed over wing sections 60' and 62' of toe plate 40' shown in FIG. 7. The tip covers can be rubber or plastic and extend from the rearmost end of the tips 68 and 70 for about half the distance to central section 42'. Otherwise, toe plate 40' is identical to toe plate 40.

Figure 8:
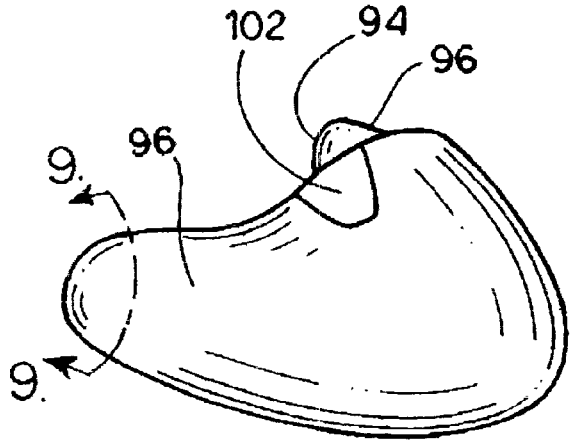
FIG. 8 is a perspective view of a toe plate having cushions thereon.
Figure 9:
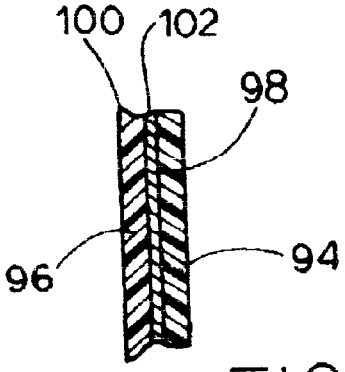
FIG. 9 is an enlarged and fragmentary, cross-sectional view taken along line 9—9 of FIG. 8.

Referring to FIGS. 8 and 9, yet further comfort can be provided by including cushions 94 and 96 on inside surface 98 and outside surface 100 respectively of a steel shell 102 of a toe plate 40'. The steel shell is thus sandwiched between the two cushions 94 and 96. In some instances, only the inside cushion 94 is required.

A shoe can also include an insole 56 that is formed of a material that will absorb bacteria, such as geranium or the like, Insole 56 can include an arch support 110 and the shoe can include a cushioned midsole 112, with protective lining 114 being also included to further provide comfort. The shoe can contain a molded EVA cushioned midsole with a midsole wedge MS (see FIG. 6) that will provide excellent shock absorption. Air cushions 116 can be included to add comfort to the shoe. As discussed above, the shoe can include a high tech rubber compound for the sole as well as canvas, nylon mesh or leather for the upper. Latex materials can also be included for the vamp 18 as well as padding on a heel patch achilles' tendon pad 120 and the heel section 20. Polyurethane foam can be used as thermal insulation 122. Latex materials can also be used in the remainder of heel section 20 if desired.

In summary, the footwear construction of the present invention provides an individual with a more comfortable lightweight workshoe in the form of a sneaker. The footwear construction will keep the wearer's feet safe from both impact associated with walking or standing for long periods as well as potential contact from falling objects. The footwear construction of the present invention will allow a wearer to conserve energy by not wasting energy on fatigue associated with impact due to walking and/or standing and is amendable to use with a wide variety of shoes.

Referring to FIG. 2, the various shapes and curvatures and relative sizes are seen for the toe plate 40 of the present invention. Thus, referring to FIG. 2, it can be seen that toe plate 40 includes a one-piece body 150 which includes a hollow dome-shaped main section 152 having a front tip section 48, a rear edge 154, and a bottom rim 52. Main section 152 has an inside tip radius of curvature (not visible in FIG. 2, but matching outside tip radius of curvature 48R, an inside rear edge radius of curvature 154R, two side radii of curvature on the inside of the main section and thus not visible in FIG. 2, but matching the outside radius of curvature 156R, it being observed that the side radii of curvature are similar to each other and different from both the tip radius of curvature 48R and the inside rear edge radius of curvature 154R.

As discussed above, the toe plate 40 includes first and second wings 60 and 62. Each wing 60 and 62 extends from tapered portion 66 of main section 152 to a rearmost tip 160, and include a top edge 164 and a bottom edge 166. The bottom edges 166 are each co-planar with bottom rim 52 of main section 152. Each wing 60 and 62 further includes an inside radius of curvature (not visible in FIG. 2) that matches the inside radius of curvature of the side of main section 152 associated therewith. The top edge of each wing is curved with a first radius of curvature 164R and a rearmost tip radius of curvature 160R, and further has a curvature of transition C smoothly joining the first radius of curvature to the rear edge of the main section 152. It is noted that the curved tips of each of the wings 60 and 62 is smooth to prevent the wings from irritating the wearer's foot by locating a sharp corner near the foot. Curvature of transition C being curved in two planes (in the plane of the paper and into the paper in FIG. 2) and having a plurality of radii of curvature which smoothly connect top edge 164 to rearmost tip radius 160R and to the top edge of main section 152.

As shown in FIG. 3, the main section 152 has a main section height H measured between the tapered portion 66 thereof and bottom rim 52, and each of the wings 60 and 62 has a wing height w measured between the bottom edge thereof and the top edge thereof. Main section rear height H is greater than wing height W.

As discussed above, protective toe plate 40 is used in a running shoe having a toe box 22 with the one-piece body being releasably located inside said toe box 22 and held in place inside the toe box 22 solely by friction so it can be easily removed from the shoe and placed in another shoe whenever a user wishes.

It is understood that while certain forms of the present invention have been illustrated and described herein, it is not to be limited to the specific forms or arrangements of parts described and shown.

We claim:

1. A footwear construction comprising:

a general purpose shoe having a soft, flexible upper, a soft, flexible vamp and a toe box; and a protective toe plate positioned inside the toe box of said shoe and including:

a central section that covers a wearer's toes when said toe plate is in place inside the toe box of said shoe, two wings, each wing being located on said central section to be located adjacent to the sides of said shoe and interposed between one of the sides of said shoe and a big toe of the wearer and between another side of said shoe and a little toe of the wearer when said toe plate is in position inside the toe box of said shoe, an elastomeric cover on each wing of said two wings and a tapered wing section between each wing and said central section.

2. The footwear combination defined in claim 1 wherein said elastomeric cover is rubber.

3. The footwear combination defined in claim 1 wherein said protective toe plate is steel.

4. The footwear combination defined in claim 1 further including an insole in said shoe.

5. The footwear combination defined in claim 1 wherein said protective toe plate is steel.

6. The footwear combination defined in claim 1 wherein said toe plate is one-piece construction.

7. The footwear combination defined in claim 1 wherein said toe plate is U-shaped.

8. The footwear combination defined in claim 1 further including an insole in said shoe.

9. The footwear combination defined in claim 1 further including a cushion on said protective toe plate.

10. The footwear combination defined in claim 9 wherein said cushion is located on an inside surface of said toe plate to be interposed between said toe plate and a foot of the wearer when said toe plate is in place inside said toe box.

11. The footwear combination defined in claim 10 further including an insole in said shoe.

12. A protective toe plate for use in footwear comprising:

a central section that covers a wearer's toes when the toe plate is in place inside a shoe box of a shoe;

two wings, each wing being located on said central section to be located adjacent to sides of the shoe and interposed between one of the sides of the shoe and a big toe of the wearer and between another side of the shoe and a little toe of the wearer when said toe plate is in position inside the toe box of the shoe;

an elastomeric cover on each wing section of said two wing sections and a tapered wing section between each wing and said central section.

13. The protective toe plate defined in claim 12 wherein said elastomeric cover is rubber.

14. The protective toe plate defined in claim 12 further including a cushion on said protective toe plate.

15. The protective toe plate defined in claim 14 wherein said cushion is located on an inside surface of said toe plate to be interposed between said toe plate and a foot of the wearer when said toe plate is in place inside said toe box.

16. A protective toe plate for use in footwear comprising:

a one-piece body which includes:

a hollow dome-shaped main section having a front tip, a rear edge, a bottom rim, said main section having an inside tip radius of curvature, an inside rear edge radius of curvature, two side radii of curvature, said side radii of curvature being similar to each other and different from both the tip radius of curvature and said inside rear edge radius of curvature, first and second wings, each wing extending from the rear edge of said main section to a rearmost tip, and including a top edge and a bottom edge, with the bottom edge being co-planar with the bottom rim of said main section, an inside radius of curvature that matches the inside radius of curvature of the side of said main section associated therewith, the top edge of each wing being curved with a first radius of curvature and a rearmost tip radius of curvature, and having a curvature of transition smoothly joining the first radius of curvature to the rear edge of said main section, said curvature of transition being curved in two planes and having a plurality of radii of curvature which smoothly connect said top edge to said rearmost tip radius and to the top edge of said main section, said main section having a main section height measured between the rear edge of said main section and the bottom rim of said main section, each of said wings having a wing height measured between the bottom edge thereof and the top edge thereof, said main section rear height being greater than said wing height; and a running shoe having a toe box, said one-piece body being releasably located inside said toe box.

17. The protective toe plate defined in claim 16 wherein said one-piece body is held in place inside said toe box solely by friction.

* * * * *